United States Patent [19]

Rosen et al.

[11] Patent Number: 4,765,128

[45] Date of Patent: Aug. 23, 1988

[54] DEVICE FOR PRODUCING A THREAD CONNECTION BY SPLICING

[75] Inventors: Klaus Rosen, Moenchengladbach; Josef Bertrams, Wegberg; Rudolf Consoir, Hückelhoven; Heinz Differding, Moenchengladbach; Reinhard Mauries, Moenchengladbach; Heinz Zumfeld, Moenchengladbach; Wolfgang Irmen, Moenchengladbach, all of Fed. Rep. of Germany

[73] Assignee: W. Schlafhorst & Co., Moenchengladbach, Fed. Rep. of Germany

[21] Appl. No.: 894,690

[22] Filed: Aug. 8, 1986

[30] Foreign Application Priority Data

Aug. 9, 1985 [DE] Fed. Rep. of Germany ..... 3528619

[51] Int. Cl.[4] ..... D01H 15/00

[52] U.S. Cl. ..... 57/22

[58] Field of Search ..... 57/22

[56] References Cited

U.S. PATENT DOCUMENTS

| | | | |
|---|---|---|---|
| 4,492,076 | 1/1985 | Romic | 57/22 |
| 4,499,715 | 2/1985 | Chardon et al. | 57/22 |
| 4,577,458 | 3/1986 | Garnsworthy | 57/22 |
| 4,653,258 | 3/1987 | Rohner | 57/22 |

*Primary Examiner*—Donald Watkins

*Attorney, Agent, or Firm*—Herbert L. Lerner; Laurence A. Greenberg

[57] ABSTRACT

A device for producing a thread connection by splicing includes a splicing head having a splicing chamber formed therein in which a tension-proof thread connection is formed by mutually entangling, hooking, intermingling and/or wrapping fibers of thread ends, means for supplying heated splicing air to the splicing channel, and an adjustable heat source coupled to the splicing head.

10 Claims, 3 Drawing Sheets

DEVICE FOR PRODUCING A THREAD CONNECTION BY SPLICING

The invention relates to a device for producing a thread connection by splicing, wherein mutual entangling, hooking, intermingling and/or wrapping of the fibers of the thread end lead to a tension-proof connection of the threads, including a splicing head with a splicing channel to which heated splicing air can be supplied.

A disadvantage of splicing with hot air is that quite varied results are obtained.

It is accordingly an object of the invention to provide a device for producing a thread connection by splicing, which overcomes the hereinafore-mentioned disadvantages of the heretofore-known devices of this general type, which improves the results obtained during splicing, and which produces more uniform splices.

With the foregoing and other objects in view there is provided, in accordance with the invention, a device for producing a thread connection by splicing, comprising a splicing head having a splicing chamber formed therein in which a tension-proof thread connection is formed by mutually entangling, hooking, intermingling and/or wrapping fibers of thread ends, means for supplying heated splicing air to the splicing channel, and an adjustable heat source coupled to the splicing head. In this way, the splicing head itself is heated to a sufficiently constant temperature and maintained at this temperature. This feature improves the splicing results considerably.

In accordance with another feature of the invention, there is provided a basic body on which the splicing head and the adjustable heat source or another heating source are disposed, and at least one pneumatic holding and preparing device disposed on the basic body for at least one thread end.

The thermal coupling between the heat source and the splicing head is most simply accomplished by direct contact. If it is not intended to heat the basic body as well, it can be insulated from the splicing head by an insulating layer, and in some cases it can be also insulated from the heat source.

In accordance with an added feature of the invention, the adjustable heat source includes means for adjusting temperature in the splicing head to between 50° and 80° C.

In accordance with an additional feature of the invention, the adjustable heat source includes an electric heating element and a thermostat regulating the heating element. The thermostat can be contained in the heating element. It is not absolutely necessary to place the thermostat directly at the splicing head.

In accordance with a further feature of the invention, the air supply means is a line conducting splicing air, and including another adjustable heat source connected to the air supplying means.

The splicing air is heated as it flows in, which leads to a characteristic temperature distribution during the splicing period. This is considered as one of the causes for the improved splicing result.

In accordance with again another feature of the invention, the other adjustable heat source includes means for heating the splicing air to a temperature between 150° and 400° C. above the temperature of the environment. This temperature range enhances the splicing result, especially when splicing woolen yarns.

In accordance with again an added feature of the invention, the other adjustable heat source includes an electric heating element and a thermostat regulating the heating element.

In accordance with again an additional feature of the invention, there is provided a temperature regulating device for controlling one of the adjustable heat sources including a thermostat connected to the one adjustable heat source, and a second thermostat may also be provided for measuring the temperature gradient of the one adjustable heat source.

In accordance with again a further feature of the invention, the temperature regulating device includes at least one temperature-dependent switch, and safety devices operatively connected to the switch for preventing operation of the splicing head at temperatures which are too high and at temperatures which are too low.

In accordance with a concomitant feature of the invention, the safety devices include a switching device for interrupting current supply to the other adjustable heat source, a switching device for interrupting current supply to the splicing head or to a thread insertion device, and a malfunction indicator.

If pneumatic holding and preparing devices are used, such devices can be operated with heated air instead of cold air. The preparation of the thread ends is thus improved along with an enhancement of the result of the splicing operation.

Other features which are considered as characteristic for the invention are set forth in the appended claims.

Although the invention is illustrated and described herein as embodied in a device for producing a thread connection for splicing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
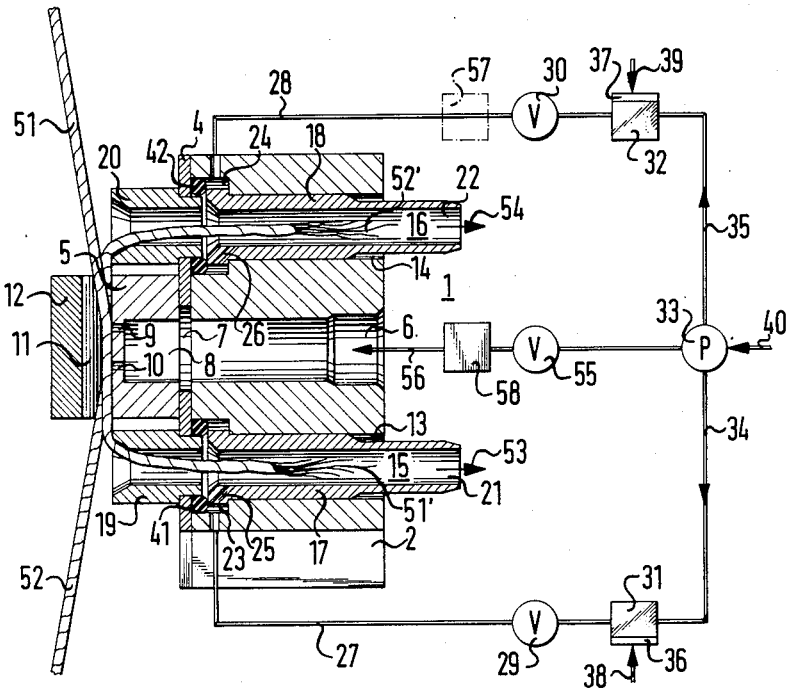
FIG. 2 is a cross-sectional view of the hot-air thread splicing device, taken along the line II—II in FIG. 1, in the direction of the arrows.

Referring now to the figures of the drawings in detail and first, particularly to FIG. 2 thereof, there is seen a hot-air thread splicing device which is designated as a whole with reference numeral 1 and which includes only those parts which are essential for an understanding of the invention. The thread splicing device 1 has a basic body 2 on which a plate 4 and a splicing head 5 are mounted by a fastening screw 3. A bore 6 formed in the basic body 2 is connected through a perforation or passageway 7 in the plate 4 to a bore 8 formed in the splicing head 5. From the bore 8, two hot-air injection openings 9 and 10 lead into a splicing chamber 11, which can be closed by a cover 12. The cover 12 is opened for inserting or removing threads, while during the splicing operation the cover 12 closes the front of the splicing chamber. Two additional bores 13, 14 in the basic body 2 serve for receiving two pneumatic holding and preparing devices 15, 16.

The pneumatic holding and preparing device 15 includes a tube 17 which continues in a tubular attachment 19 toward the front, which serves as inlet orifice. The pneumatic holding and preparing device 16 has a tube 18 which continues in a tubular attachment 20 toward the front. The tubular attachments 19 and 20 are fitted into the plate 4 and are fastened there. The tube 17 has a flow channel 21 therein and is surrounded at its upper end by a ring channel 23 and the tube 18 has a flow channel 22 therein and is surrounded at its upper end by a ring channel 24. Both ring channels are disposed in the basic body 2. The ring channel 23 is connected by an injector bore 25 with the flow channel 21 and the ring channel 24 is connected by an injector bore 26 with the flow channel 22. The ring channel 23 is attached through a line 27 and a control valve 29 to a hot-gas source 31. The ring channel 24 is attached through a line 28 and a control valve 30 to a hot-gas source 32. The hot gas sources may be heat exchangers, for instance, which heat fresh air coming from a compressor 33. The fresh air is conducted through respective lines 34, 35 to the hot gas sources 31, 32.

The hot gas source 31 has a gas humidifying device 36 and the hot gas source 32 has a gas humidifying device 37.

The compressor 33 sucks in fresh air through a line 40, compresses it, and conducts it through the lines 34 and 35 to the hot gas sources 31 and 32, where the air is heated to a temperature of about 100° C.elsius and charged with humidity by injecting water with the aid of the humidifying devices 36 and 37. The water is supplied through respective lines 38, 39.

Since positive pressure is maintained in the ring channels 23 and 24 during the preparation of the thread ends, rubberelastic O-rings 41 and 42 are provided for sealing as well as for holding the tubes 17 and 18.

Figure 1:
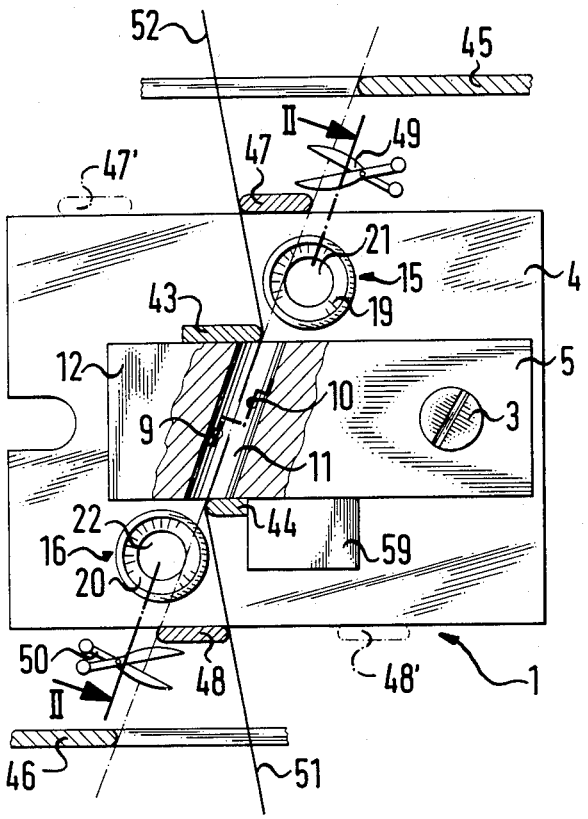
FIG. 1 is a fragmentary, diagrammatic, front-elevational view of a hot-air thread splicing device.

FIG. 1 shows a thread insertion device, wherein a cover plate 43 is provided at the upper end of the splicing chamber 11 which partly covers the splicing chamber and a similar cover plate 44 is disposed at the lower end of the splicing chamber 11. The basic body 2 carries a thread guide plate 45 on top and a thread guide plate 46 at the bottom. As indicated only in FIG. 1 respective loop pullers 47, 48 and respective thread cutting or separating devices 49, 50 are disposed between the cover plates 43, 44 and the thread guide plates 45, 46. The loop puller 47 can be moved to a position 47' and the loop puller 48 can be moved to a position 48'.

FIG. 1 shows the position of threads 51 and 52 after they are inserted into the splicing chamber 11, but before they are cut and therefore before thread ends 51', 52', shown especially in FIG. 2, are formed. The thread 51 comes from the bottom right, changes its direction at the cover plate 44, passes through the splicing chamber 11, and is conducted toward the upper right through the pneumatic holding and preparing device 15 and through the open thread cutting device 49. The other thread 52 comes from the upper left, changes its direction at the cover plate 43, passes through the splicing chamber 11, and is conducted toward the lower left through the pneumatic holding and preparing device 16 and through the open thread cutting device 50.

The thread ends 51' and 52' shown in FIG. 2 are formed by the operation of the two thread cutting devices 49, 50. When the threads are cut, the valves 29 and 30 simultaneously open, so that the climatized hot air flows into the ring channels 23 and 24, and from there through the injection bores 25 and 26 into the flow channels 21 and 22. A turbulent hot air stream is therefore formed, which reaches the outside in the direction of arrows 53 and 54. The hot-air stream pulls along air from the surroundings, so that the thread ends are first moved into the tubular attachments 19, 20 and from there into the flow channels 21 and 22, as shown in FIG. 2.

The two valves 29 and 30 remain open for a limited time. During this time, tufts are formed at the ends of the threads which are formed of open-ended individual fibers, as indicated in FIG. 2. Subsequently, the two loop pullers 47 and 48 are moved to the positions 47', 48', respectively, so that they take along the threads 52, 51, respectively, forming loops, and the thread ends 51' and 52' are pulled out of the flow channels 21 and 22 and moved into the splicing chamber 11. During this time, the valves 29 and 30 may remain open. However, this is not required in all cases.

In order to perform the actual splicing with the cover 12 closed, a valve 55 is opened so that compressed air is blown from the compressor 33 through a heat source 58 and a line 56 into the bore 6. This creates a positive pressure in the bore 6 which escapes through the hot-air injection openings 9 and 10 into the splicing chamber 11. The outflowing hot air causes a mutual entangling, hooking, intermingling and/or wrapping of the fibers of the thread ends and thereby results in a strong splice connection.

After the splice connection is produced, the cover 12 is opened, so that the threads 51 and 52 which are joined together, can jump out of the splicing chamber 11, if thread tension is generated, such as by restarting a winding device, for example.

According to FIG. 1, the splicing head 5 and the plate 4 are in contact with an adjustable heat source 59. According to FIG. 3, the heat source 59 is provided with an electric heating element 62, which can be regulated by a thermostat. The basic body 2 is also in thermal contact with the heat source 59 through the plate 4, so that not only the splicing head 5, but also the pneumatic holding and preparing devices 15 and 16, are heated.

Figure 3:
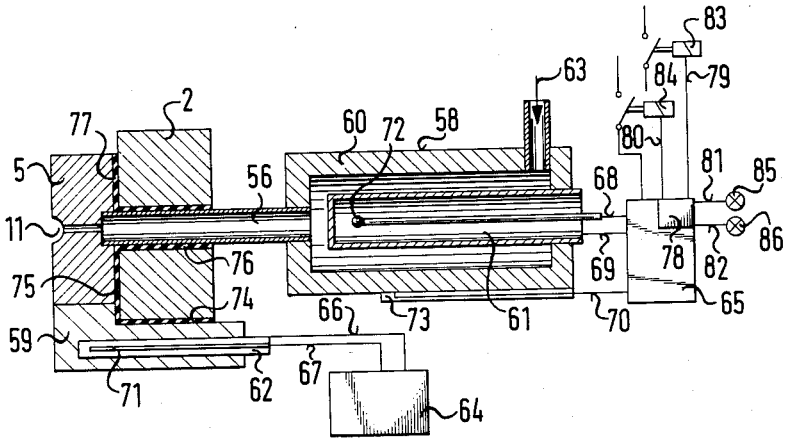
FIG. 3 is a schematic circuit diagram and cross-sectional view of a portion of the device according to the invention.

According to FIG. 3, the heat source 58 shown in FIG. 2 is formed of an insulating housing 60, which contains a controllable heating element 61 that is surrounded by the splicing air. The compressed or splicing air flows into the housing 60 in the direction of an arrow 63.

According to FIG. 3, in order to maintain the temperature, two regulating devices 64 and 65 are provided. The regulating device 64 is connected through a line 66 with the heating element 62 and through a line 67 with a thermostat 71 of the heat source 59. The desired temperature can be set at the regulating device 64, such as by digital means, for example. During the heating phase, electrical energy is supplied to the heating element 62 through the line 66. When the desired temperature is reached, the thermostat 71 causes the energy supply through the line 67 to be cut off, and after the temperature has fallen again, the heating element 62 is turned on again, and so on.

The regulating device 65 is connected through a line 69 with the heating element 61 of the heat source 58, through a line 68 with a thermostat 72 and through a line 70 with a thermostat 73. The thermostat 73 serves as a thermometer probe which registers the temperature gradient of the heat source 61, while the thermostat 72 measures the temperature of the heating element 61 of the heat source 58.

For example, the desired temperature of the heat source 58 and the temperature gradient between the measuring point of the thermostat 72 and the measuring point of the additional thermostat 73 which should be reached after heating, can be adjusted by digital means at the regulating device 65. During heating, electrical energy is supplied to the heat source 58 through the line 69.

When the desired temperature is reached, the thermostat 72 turns off the energy supply. The temperature then falls below the threshold, and causes the same thermostat to turn on the energy source again, and so on.

FIG. 3 also shows that if the holding and preparing devices are not to be heated, insulating coverings 74 to 77 can be provided. The insulating covering 74 separates the basic body 2 from the heat source 59. The insulating covering 75 separates the basic body 2 from the heat source 59 and from the splicing head 5. The insulating covering 76 separates the basic body 2 from the compressed air line 56. The insulating cover 77 separates the basic body 2 from the splicing head 5.

According to FIG. 3, the regulating device 65 has a switch 78, which is temperature-dependently controlled by the thermostat 72. Four operative or functional connections 79 to 82 originate from the switch 78. The connection 79 leads to a switching device 83 in the form of a contactor or relay, which interrupts the current supply to the thread splicing device 1 and to a non-illustrated thread insertion device, if the temperature of the heat source 58 falls below predetermined values and if the predetermined temperature gradient is not present, i.e. if the temperature measured by the thermostat 73 lies outside a predetermined value. The operating connection 80 leads to a switching device 84 in the form of a contactor or relay, which interrupts the current supply to the heat source 58, if the latter exceeds a predetermined limit value. At the same time, in the case of overheating, a malfunction or disturbance indicator 85 is lighted through the operational connection 81. However, if the temperature of the heat source 58 lies within the limit values and the predetermined temperature gradient is present, an indicator 86 is lighted through the connection 82, indicating that the thread splicing device 1 is ready to operate.

The invention is not limited to the illustrated and described embodiment which is used as an example.

For instance, in FIG. 2 a position 57 is indicated in phantom where an air heater, which is similar in principle to the air heater 58 according to FIG. 3, could be disposed. If such air heaters are provided for the preparation of the thread ends, hot gas sources 31 and 32 and the valves 29 and 39, can be omitted.

We claim:

1. Device for producing a thread connection by splicing, comprising a splicing head having a splicing channel formed therein in which a tension-proof thread connection is formed by mutually entangling, hooking, intermingling and/or wrapping fibers of thread ends, means in the form of a line for supplying heated splicing air to said splicing channel, an adjustable heat source coupled to said splicing head, another adjustable heat source connected to said air supplying means, and a temperature regulating device for controlling said other adjustable heat source including a first thermostat connected to said other adjustable heat source and a second thermostat measuring the temperature gradient of said other adjustable heat source.

2. Device according to claim 1, including a basic body on which said splicing head and said first-mentioned adjustable heat source are disposed, and at least one pneumatic holding and preparing device disposed on said basic body for at least one thread end.

3. Device according to claim 1, wherein said first-mentioned adjustable heat source includes means for adjusting temperature in said splicing head to between 50° and 80° C.

4. Device according to claim 1, wherein said first-mentioned adjustable heat source includes an electric heating element and a thermostat regulating said heating element.

5. Device according to claim 1, wherein said other adjustable heat source includes means for heating the splicing air to a temperature between 150° and 400° C. above the temperature of the environment.

6. Device according to claim 1, wherein said other adjustable heat source includes an electric heating element and a thermostat regulating said heating element.

7. Device according to claim 1, wherein said first-mentioned adjustable heat source is separate from said air supplying means and directly heats said splicing head.

8. Device for producing a thread connection by splicing, comprising a splicing head having a splicing channel formed therein in which a tension-proof thread connection is formed by mutually entangling, hooking, intermingling and/or wrapping fibers of thread ends, a thread insertion device for inserting threads in said splicing channel, means in the form of a line for supplying heated splicing air to said splicing channel, an adjustable heat source coupled to said splicing head, another adjustable heat source connected to said air supplying means, and a temperature regulating device for controlling said other adjustable heat source including a thermostat connected to said other adjustable heat source, at least one temperature-dependent switch, and safety devices operatively connected to said switch for preventing operation of said splicing head at temperatures which are too high and at temperatures which are too low, said safety devices including a switching device for interrupting current supply to said other adjustable heat source, a switching device for interrupting current supply to said thread insertion device, and a malfunction indicator.

9. Device according to claim 8, wherein said safety devices also include a switching device for interrupting current supply to said splicing head.

10. Device according to claim 8, wherein said first-mentioned adjustable heat source is separate from said air supplying means and directly heats said splicing head.

* * * * *